United States Patent [19]

Sekiguchi

[11] Patent Number: 4,571,105

[45] Date of Patent: Feb. 18, 1986

[54] LEAD ENGAGING CHUCK MECHANISM FOR MECHANICAL PENCIL

[75] Inventor: Tomozo Sekiguchi, Kawaguchi, Japan

[73] Assignee: Pentel Kabushiki Kaisha, Tokyo, Japan

[21] Appl. No.: 538,652

[22] Filed: Oct. 3, 1983

[51] Int. Cl.[4] ..... B43K 21/16

[52] U.S. Cl. ..... 401/65; 401/53; 401/67; 401/94

[58] Field of Search ..... 401/65, 67, 93, 94, 401/53

[56] References Cited

U.S. PATENT DOCUMENTS

| | | | |
|---|---|---|---|
| 275,517 | 4/1883 | Pusey | 401/53 |
| 1,633,529 | 6/1927 | Hoffmann | 401/65 |
| 1,636,704 | 7/1927 | Patten | 401/65 |
| 1,700,246 | 1/1929 | Woelm | 401/65 |
| 1,700,247 | 1/1929 | Woelm | 401/65 |
| 1,724,412 | 8/1929 | Pollack | 401/67 |
| 1,762,317 | 6/1930 | Woelm | 401/65 |
| 2,184,911 | 12/1939 | Fend | 401/65 |
| 2,210,845 | 8/1940 | Wahl | 401/65 |

FOREIGN PATENT DOCUMENTS

| | | | |
|---|---|---|---|
| 0088318 | 9/1983 | European Pat. Off. | 401/53 |
| 2105657 | 3/1983 | United Kingdom | 401/65 |

*Primary Examiner*—Richard J. Apley
*Assistant Examiner*—Robert W. Bahr
*Attorney, Agent, or Firm*—Wenderoth, Lind & Ponack

[57] ABSTRACT

A chuck mechanism incorporated in a mechanical pencil has a plurality of chuck elements in a longitudinal confronting relation. The chuck elements have a pivotal support or fulcrum at their opposing rearward portions so that the elements are pivotable about the fulcrum. The fulcrum is formed proximal to the rear end and distal to the front end jaw portions of the chuck elements. When an axial force is applied to the chuck elements, the jaw portions of the chuck elements are opened to release lead engagement thereby. The rear portion relative to the fulcrum is a portion where an axially forward thrust added thereto is converted to a radially inward thrust to the rear portion.

4 Claims, 13 Drawing Figures

LEAD ENGAGING CHUCK MECHANISM FOR MECHANICAL PENCIL

BACKGROUND OF THE INVENTION

The present invention relates in general to a mechanical pencil and more particularly to a lead engaging chuck mechanism which is mounted within a barrel of the mechanical pencil.

The lead engaging chuck for a mechanical pencil generally has a rear portion which receives an end of a helical spring to bias the chuck rearwardly, a lead grasping front portion or jaw portion which is generally closed to engage therein a writing lead by a radially inward force which has been converted from an axial force of the spring, and a middle portion which connects together the rear portion and the lead engaging front portion. The chuck body is formed in a unitary structure of a single piece or otherwise formed with a plurality of elements which are then assembled. In the former case of a single piece, a front portion of the chuck is provided with slits or cuts and then the slit portion is bent radially outwardly by a suitable jig or tool to form a lead gripping portion. In the latter case wherein the chuck is formed of plural separate elements, the front portion of the chuck is bent radially outwardly. In both cases, the radially outwardly inclined portion is urged radially inwardly to forcibly deform the outwardly inclined portion of the chuck to thereby provide a lead engaging force. On the other hand, when the inward thrust added to the radially outwardly inclined portion is released, the lead gripping portion of the chuck is opened automatically by its resiliency.

However, the conventional lead engaging mechanism of the chuck as described above encounters some problems. For instance, since the chuck is forcibly closed against its own resiliency during a much longer period of time than it is released, the resilient force itself becomes weaker, and finally prevents a smooth lead feed action through the chuck which does not open sufficiently due to the reduced resiliency. In order to avoid such a disadvantage, the chuck has been provided with a stronger resilient force, which however requires a stronger spring for retracting the chuck and closing the lead engaging portion against the stronger resilient force of the lead engaging portion, thereby resulting in difficulty in projecting the lead outwardly from the writing tip for writing purposes. Further, lead powder which is produced by the stronger force of the lead engaging portion is accumulated to block the lead feed action and to cause failure of lead engagement for writing purposes.

SUMMARY OF THE INVENTION

An object of the present invention is to provide an improved chuck structure which permits a reliable open-close operation of a lead engaging portion of the chuck.

Another object of the present invention is to provide a new chuck mechanism which does not rely upon the inherent resiliency of the chuck body.

Another object of the present invention is to provide an improved chuck structure for a mechanical pencil, which can be closed for engaging the lead therein with a relatively small force of a spring.

A further object of the present invention is to provide a new chuck mechanism for a mechanical pencil, which is simple in structure and can be manufactured economically.

An additional object of the present invention is to provide a new chuck mechanism with which it is possible to release the lead from the chuck with a relatively smaller force imported to the chuck by manipulation from, in general, a rear end of the pencil.

Briefly, the chuck mechanism according to the present invention has a plurality, preferably two, of chuck elements in a confronting relation. The chuck elements each have a pivotal support or fulcrum at their opposing rearward portions so that the elements are pivotable at the fulcrum. The fulcrum is formed proximal to the rear end and distal to the front lead gripping portions. In an embodiment of the invention, the rear portions relative to the fulcrum are portions where the advancing force against the axial force of a spring which biases the chuck rearwardly is converted into a grasping force in a radially inward direction towards a longitudinal axis of the chuck.

Alternatively, a resilient ring may be mounted on the portion which is close to the fulcrum so that when an axial thrust is applied to the chuck, the chuck body is advanced relative to a chuck actuation cylinder to forcibly open the lead engaging jaw portions. The chuck elements may be formed such that the rear end portions extend outwardly to form angled portions to thereby form the fulcrum.

The fulcrum can simply be formed by providing on the confronting flat surfaces a projection and a recess on one chuck element, and a recess and a projection on the other opposing element, so that the projections are received in the recesses.

DETAILED DESCRIPTION OF PREFERRED EMBODIMENT

Figures 1, 2, 3, 4, 5A, 5B, 5C, 5D:
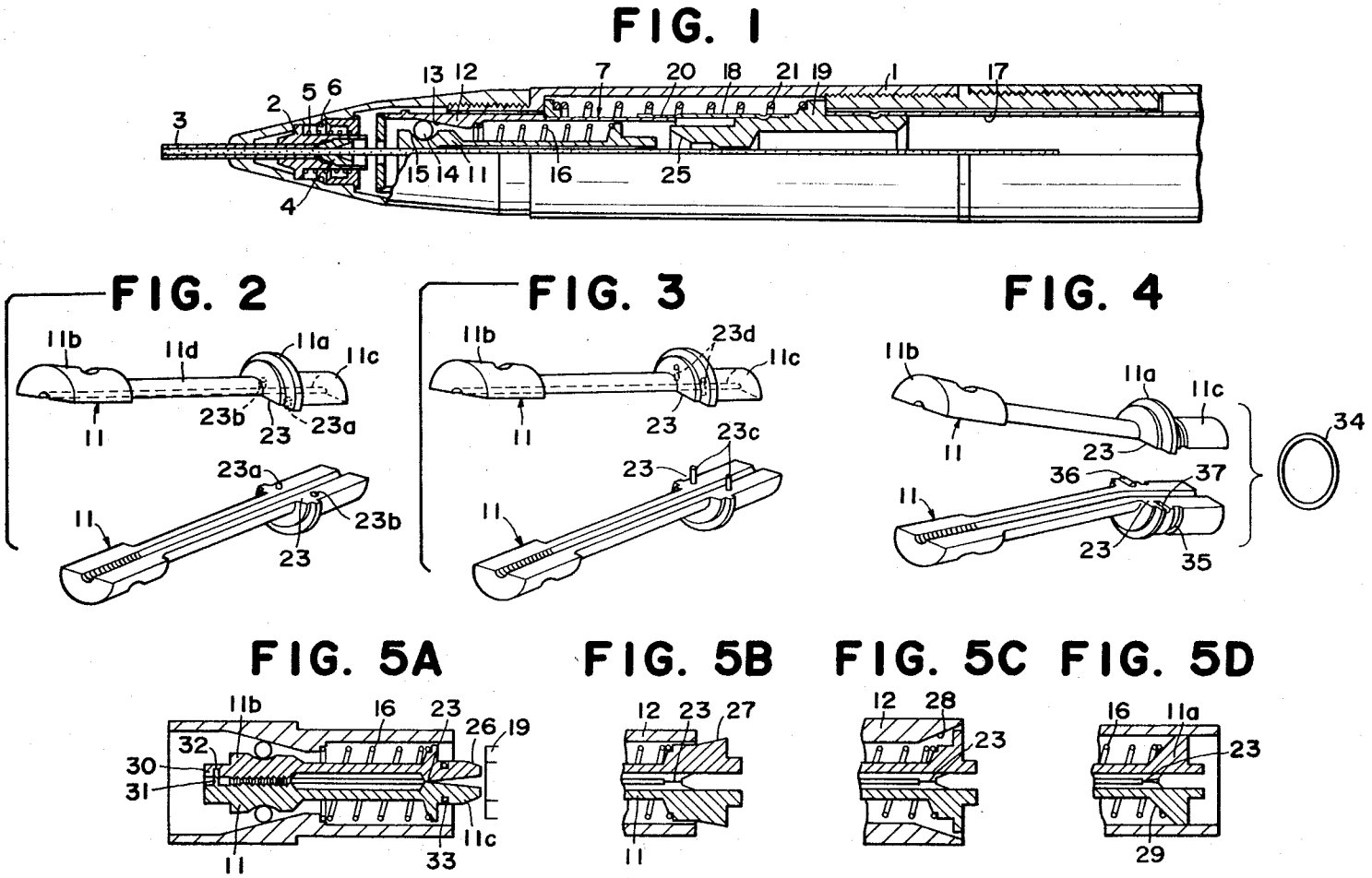
FIG. 1 is a sectional view, partly omitted for simplification purposes only, of a typical mechanical pencil, showing a chuck mechanism according to the present invention.
FIG. 2 is a perspective view of a chuck body according to an embodiment of the present invention, showing a fulcrum formed of two projections and recesses.
FIG. 3 is a perspective view of a chuck body according to another embodiment of the present invention.
FIG. 4 is a perspective view of a chuck body according to another embodiment of the invention.
FIG. 5A is a sectional view of a chuck mechanism according to another embodiment of the invention.
FIGS. 5B, 5C and 5D are sectional views of a part of a chuck mechanism according to other embodiments of the present invention.

Referring first to FIG. 1, a typical mechanical pencil is shown in which a chuck mechanism according to the present invention is employed. However, the present invention is not limited to the structure of the pencil shown in FIG. 1, but can be applied to any other type of mechanical pencil and many parts and elements can be modified if desired. The chuck mechanism according to the present invention can be applied to various types of mechanical pencils, such as the automatic lead feed pencil as shown in FIG. 1 and any other type of pencil.

The mechanical pencil shown in FIG. 1 has a barrel or casing 1 having therein a slider 2, which has a tube 3 and a ringlike lead retainer 4. The slider 2 is biased forwardly by means of a first helical spring 5. When a sufficient pressure or an axial thrust is applied against the writing tip end of the tube 3 by manually holding the pencil verticaly and pushing downwardly on the pencil with the tube in contact against a stationary object, the slider 2 is retracted a certain distance. During such retraction, the slider 2 will retract in a smooth motion to a locking member 6. A further retraction requires a further thrust since the inner diameter of the locking member 6 is smaller than the outer diameter of the slider. The slider-engaging force, i.e. frictional engaging force, of the locking ring 6 is designed to be greater than the recovery force of the first spring so that the slider 1 can be retained at its retracted position. A chuck mechanism 7 has a lead engaging jaw or chuck 11, a chuck-actuation cylinder 12 having a tapered guide surface 13 and balls 14 positioned in recessed seats 15 of the chuck 11. A second spring 16 is mounted between the chuck 11 and the chuck-actuation cylinder 12. It is desired that the force of the second spring 16 be smaller than the lead grasping force of the lead retainer 4 so that the chuck 11 may be advanced together with the lead retainer 4 which grasps the lead. A magazine 17 or lead container is rigidly connected to a friction tube 18 through a pusher 19. The friction tube 18 is frictionally engaged with the chuck-actuation cylinder 12. Reference numeral 20 designates a portion deformed for the purpose of imparting the desired frictional engagement with the cylindrical portion of the chuck-actuation cylinder 12. A third helical spring 21 is provided to determine a normal position of the chuck-actuation cylinder 12 and the magazine 17. The chuck-actuation cylinder 12 has an abutment which can push the slider 2 in a forward direction against the engagement force of the locking ring 6 when the chuck mechanism 7 is advanced from its retracted position.

The structure and operation of the mechanical pencil shown in FIG. 1, other than of the chuck mechanism according to the present invention, will become fully understood from copending U.S. patent application Ser. No. 244,326 filed Mar. 16, 1981 and the corresponding German Patent Publication No. DE31 12 869A1 published Feb. 4, 1982, which are incorporated herein by reference.

Referring to FIGS. 1 and 2 showing a chuck 11 embodying the present invention, a chuck 11 which is formed of two chuck halves or elements has a port or flange 11*a* for receiving a rear end of the spring 16, a lead gripping front or jaw portion 11*b* distal to the port 11*a*, the lead gripping portion 11*b* being biased radially inwardly by the resilient force of the spring 16, a rear portion 11*c* which is located at the rear of the port 11*a* and proximal to the port 11*a* and a middle portion 11*d* which connects the front portion 11*b* and the rear portion 11*c*.

In the present invention, the chuck is formed of a plurality, two in the illustrated embodiment, of chuck elements and a pivotal support or fulcrum 23 on the opposing inner surfaces of the chuck elements at a position adjacent to, but opposite from, the reception port 11*a*. The fulcrum 23 is formed at a position which is distal to the front portion 11*b* and proximal to the rear portion 11*c*. In the embodiment illustrated in FIG. 2, a projection 23*a* and a recess 23*b* are formed on the confronting flat surface of one chuck element, and the other chuck element also has a recess (23*b*) for receiving the projection 23*a* and a projection (23*a*) which is received in the recess 23*b* when assembled. The two chuck elements are placed in a spaced confronting relation so that the elements are pivotable about the fulcrum 23 of the projections and recesses, as described. Although each chuck element has both a projection and a recess in the illustrated embodiment, two projections can be formed on one of the chuck elements and two recesses can be formed on the other chuck element.

When the chuck as described above is used, the pusher 19 has an inwardly rearwardly inclined surface 25 as shown in FIG. 1 so that the axial thrust added to the rear end portion 11*c* of the chuck 11 is converted into a rearwardly inward thrust at the rear end portion on 11*c* to forcibly pivot the chuck elements about the fulcrum 23.

FIG. 3 shows a modification of the chuck according to the present invention, in which the fulcrum 23 is formed of two resilient pins such as rubber pins. The pins connect the chuck elements together in a confronting relation so that the chuck elements can pivot about the fulcrum 23. In the embodiment of FIG. 3, one of the chuck elements 11 has resilient pins 23*c* and the other has slots 23*d* for receiving the pins 23*c*. Alternatively, it may be designed such that each chuck element has both a resilient pin and a slot. The other structure is substantially similar to that of the embodiment shown in FIG. 2.

In order to successfully provide a ball chuck system as illustrated in FIG. 1, ball seats 15 are formed on the outer surface of the lead gripping portion of the chuck. The chuck 11 is mounted within the chuck-actuation cylinder 12 having a tapered surface 13 so that the chuck is biased rearwardly by the spring 16. Thus, the balls 14 in the ball seats 15 are pressed against the tapered guide surface 13, and the axial force of the spring 16 is converted into a radially inward force of the chuck for grasping the lead in the chuck.

In the present invention, a lead gripping force is added to the lead gripping portion 11*b* which is located distal to the pivotal support 23, and the chuck elements 11 are pivoted, by the gripping force, at the fulcrum of the pivotal support 23 to close the lead gripping portion 11*b*. Thus, the lead is engaged firmly by the chuck. When an axial force is applied to the rear end portion 11*c* of the chuck so that the chuck elements rotate about the fulcrum 23 in such a manner that the front portions 11*b* are opened away from each other, the lead engagement is released. Accordingly, it is not necessary that the chuck be forcibly deformed or pressed inwardly so as to produce a lead gripping force at the portions 11*b*.

The pivotal support or fulcrum 23, if formed of two pairs of protrusions and recesses as described above with reference to FIG. 2, merely produces very small friction which is negligible. Similarly, when the fulcrum 23 is formed of resilient pins 23*c*, a bending stress thereof can be minimized by placing the pins in a substantially non-curved or straight position at the time when the jaw portions 11*b* are closed to engage the lead.

In the chuck mechanism according to the present invention, it is not required that the spring 16 be strong enough to forcibly deform or inwardly press the outwardly extended front portion 11*b* of the chuck against the resilient force of the chuck material, and therefore manipulation of a lead feed operation can be readily accomplished.

A force for advancing the chuck 11 against a force of the spring 16 for the purpose of opening the chuck is obtained to permit the lead to move through the chuck towards the writing tip of the pencil by a manipulation or pushing of the pusher 19 through a button (not shown) which is generally mounted on the rear end of the pencil casing 1. When the pusher is activated, the chuck 11 is pushed forward, and at the same time, the axial force imparted to the rear portions 11*c* by the abutment of the pusher 19 is converted, at the rear portions 11*c*, into a radially inward force. Therefore, the chuck elements are pivoted about the fulcrum so that the front lead gripping portions 11*b* are opened away from each other. When the pusher 19 is retracted to its original position, the chuck 11 is retracted by the spring 16 to close again the lead gripping portions 11*b* by the effect of the wedging action between the balls 14 and the inclined surface 13 of the chuck actuation cylinder 12.

FIG. 4 shows a modification of the invention, in which a fulcrum is formed by merely forming the rear portions 11*c* in a slightly angled relation relative to the other portions in such a manner that the rear portions 11*c* extend slightly outwardly. In the embodiment of FIG. 4, a groove 35 is formed on the rear portions at the rear of the port 11*a* and quite adjacent to the fulcrum 23 to receive an O-ring 34. It is preferred that the O-ring be made of a suitable resilient material so that when a radially inward thrust is not applied to the front end jaw portions 11*b*, the rear end portions 11*c* are closed to permit the jaw portions to open away from each other. Since the O-ring 34 is positioned adjacent to the fulcrum, expansion and contraction of the O-ring caused by the pivotal movement of the chuck elements can be minimized, and therefore the resilient force of the O-ring can be maintained for a long period of time. On the inner surface of the rear portion 11*c*, a semicircular projection 36 and a semicircular recess 37 are formed on each chuck element for ensuring an accurate pivotal movement and abutment or positioning of the chuck elements. The projections and recesses extend at right angles relative to the longitudinal direction of the chuck body. The projection 36 of the lower chuck element is received by a recess (not shown) of the upper chuck element and the recess 37 of the lower chuck element receives a projection (not shown) of the upper chuck element. The thus formed guide device of projections and recesses assures an accurate abutment of the rear end portions 11*c*. When an axial thrust is applied to the pusher 19 (FIG. 1), the chuck body is pressed forward relative to the chuck actuation cylinder 12 (FIG. 1) to permit the jaw portions 11*b* to open by the effect of the O-ring 34.

FIGS. 5A–5D show further modifications of the chuck mechanism and its associated parts. In the illustrated modifications, the chuck 11 has a fulcrum 23, which may be formed either by a combination of projections and recesses as shown in FIG. 2, or by resilient pins as shown in FIG. 3. The chuck elements, which are suitably located in a facewise abutment relation to the lead passage located therethrough, are pivotable about the fulcrum 23 when an axial thrust is applied to the rear end of the chuck by the pusher 19.

In the chuck mechanism of FIG. 5A, the pusher 19 has a non-inclined, upright end surface as illustrated, and on the other hand the chuck 11 has at its rear end a rearwardly tapered, inclined surface 26. This structure also provides a similar operation and function as in the previous structure. In the embodiment of FIG. 5A, the chuck 11 has an extended portion 30 which extends axially and forwardly from each of the jaw portions 11*b*, and guide pins 31 projecting transversally from the extended portions 30 and slots 32 for receiving the pins 31. More specifically, one chuck element has a pin 31 and a slot (not shown) and the other chuck element has a slot 32 for receiving the pin 31 and a pin (not shown) received by the aforesaid slot (not shown). The pin and slot guide device assures a reliable facewise abutment and operation of the chuck 11. The chuck 11 has a resilient annular member such as a rubber ring 33 mounted around the rear end portions 11*c* to assure an accurate positioning and pivotal movement of the elements and to urge the rear end portions 11*c* toward each other so that the chuck elements will pivot about the fulcrum. In this structure, the chuck elements are formed such that the rear inner end portions are slightly outwardly extended or angled to form a space between the confronting surfaces. In place of the rubber ring 33, the two chuck elements can be connected at the rear end portions 11*c* by means of a rear end of the spring 16, if desired.

In the chuck mechanism of FIG. 5B, the chuck 11 has a rearwardly outwardly inclined surface 27 so that the axial thrust added to the rear portions 11*c* by the pusher 19 (FIG. 5A) is converted into a radially inward thrust when the chuck is advanced and immediately contacted, at the inclined surface 27, with the rear end of the chuck-actuation cylinder 12. In the chuck mechanism of FIG. 5C, the chuck-actuation cylinder 12 has a forwardly tapered surface 28 for providing a pivotal movement of the chuck elements when the axial thrust is applied to the chuck. FIG. 5D shows a further modification in which the reception port 11*a* of the chuck 11 for receiving the rear end of the spring 16 has a forwardly inwardly inclined surface 29. The inclined surface 29 produces a pivotal movement of the chuck elements about the fulcrum 23 when the chuck is pressed forwardly against the resilient force of the spring 16 by the pusher 19 (FIG. 1).

According to the present invention, since the pivotal movement of the chuck elements about the fulcrum 23 provides two states, that is, lead engagement and release, the chuck elements are spaced from each other or otherwise the rear end portions 11*c* of the chuck elements are outwardly inclined as shown in FIG. 4, so that the lead gripping portions 11*b* can be opened sufficiently wide to allow release of the lead.

The operation of the chuck mechanism shown in FIG. 4 now will be explained with reference to FIGS. 6A–6E. The operation of the other embodiments of the present invention are analogous and will be apparent to one skilled in the art.

Figure 6A:
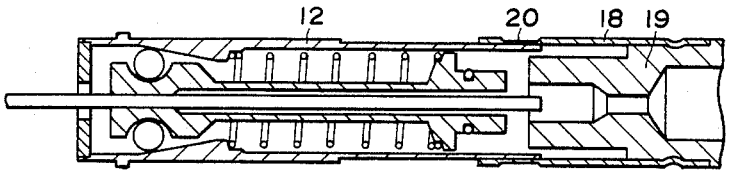
FIGS. 6A–6E are sectional views illustrating the manner of operation of the chuck mechanism of the embodiment of FIG. 4.
Figure 6B:
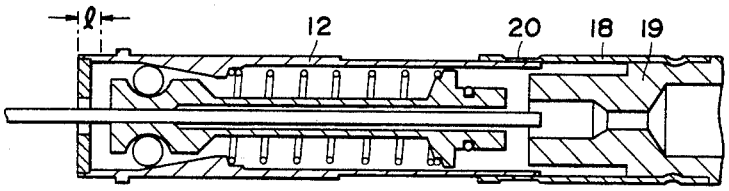
Figure 6C:
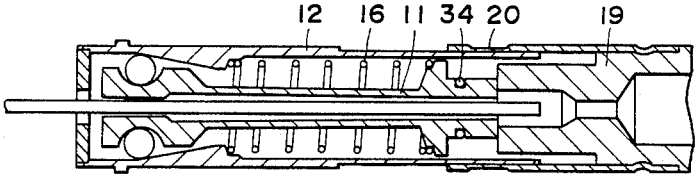
Figure 6D:
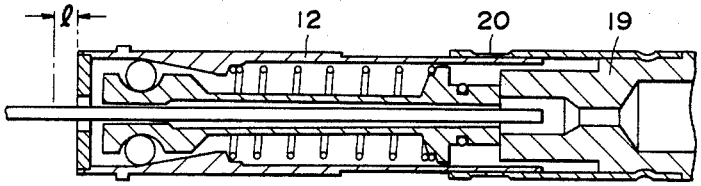
Figure 6E:
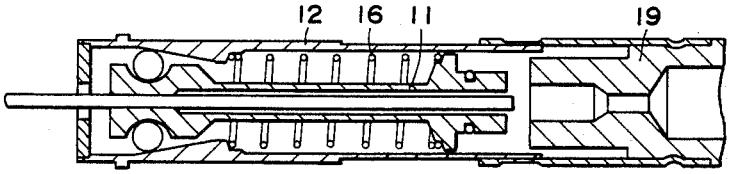

Thus, FIG. 6A shows chuck body 11 of the embodiment of FIG. 4 mounted within chuck actuation cylinder 12 shown in FIG. 1. The chuck mechanism is in the lead gripping position. FIG. 6B is similar, but indicates the initiation of advancement of pusher 19 so that the lead is projected from a writing tip. Chuck actuation cylinder 12, which is frictionally engaged with portion 20 of friction tube 18 fixed to pusher 19, is advanced the same distance 1. FIG. 6C illustrates that, after the chuck actuation cylinder 12 has advanced a predetermined distance, further displacement is limited by, for example, contact with a shoulder (not shown) formed on an inner surface of tubular casing 1. Accordingly, when the pusher 19 is advanced further, it is displaced forwardly relative to the chuck actuation cylinder 12 so that the frictional contact portion 20 is moved, and pusher 19 then pushes against the rear end of the chuck body 11. When the chuck body 11 receives this forward axial thrust, and moves forwardly against the spring force of spring 16 relative to the chuck actuation cylinder 12, the forward portion of the chuck body is opened or moved radially outwardly to release the lead by the force of O-ring 34 mounted at the rear portion of the chuck body 11 adjacent the flange receiving the force of spring 16. In FIG. 6D, when the forward thrust is released, pusher 19 is retracted by spring 21 (FIG. 1) along with chuck actuation cylinder 12 with the chuck body still being in the lead disengagement position. That is, the lead open position of the chuck body is unchanged, and the chuck body is retracted together with cylinder 12 by predetermined distance 1. FIG. 6E shows chuck actuation cylinder 12 retracted by predetermined distance 1 until it abuts a contact portion of tubular casing 1, but pusher 19 is retracted further after retraction of cylinder 12 is restricted. Thus, the front portion of pusher 19 is released from chuck body 11. The chuck body 11 then is moved axially rearwardly by spring 16, until the chuck body is closed to firmly grasp the writing lead therein.

Although the present invention has been described with reference to preferred embodiments thereof, many modifications and alterations can be made within the spirit of the invention.

For example, the semicircular shaped longitudinal projection 36 and recess 37 of the embodiment of FIG. 4 can be changed to the combination of a triangular shaped longitudinal projection and recess (not shown).

What is claimed is:

1. In a lead engaging chuck mechanism for a mechanical pencil, said mechanism being of the type including an axially movable chuck body, and a chuck actuation cylinder surrounding said chuck body in such a manner that axial movement of said chuck body in opposite directions within said chuck actuation cylinder moves said chuck body radially between positions for engagement and disengagement of a writing lead within said chuck body, the improvement wherein:

said chuck body comprises a plurality of longitudinal chuck elements positioned in longitudinal confronting relation, each said chuck element having a flange portion acted on by a spring means for biasing said chuck body axially rearwardly with respect to said chuck actuation cylinder to said engagement position, a rear end portion for receiving an axial forward thrust to move said chuck body against said spring means to said disengagement position, and a lead engaging front portion urged by said chuck actuation cylinder in said engagement position by the spring force of said spring means to grip the writing lead;

fulcrum means positioned at confronting portions of said chuck elements at locations adjacent said flange portions for enabling relative pivotal movement of said chuck elements when in said disengagement position; and taper means for imparting radial inward movement to said rear end portions about said fulcrum means, and thereby radial outward movement of said lead engaging front portions about said fulcrum means, upon receipt by said rear end portions of said axial forward thrust to move said chuck body against said spring means to said disengagement position.

2. The improvement claimed in claim 1, wherein said taper means comprises a rearwardly outwardly inclined surface formed on a rear portion of said chuck body.

3. The improvement claimed in claim 1, wherein said taper means comprises a forwardly tapered surface formed on a rear portion of said chuck actuation cylinder.

4. In a lead engaging chuck mechanism for a mechanical pencil, said mechanism being of the type including an axially movable chuck body, and a chuck actuation cylinder surrounding said chuck body in such a manner that axial movement of said chuck body in opposite directions within said chuck actuation cylinder moves said chuck body radially between positions for engagement and disengagement of a writing lead within said chuck body, the improvement wherein:

said chuck body comprises a plurality of longitudinal chuck elements positioned in longitudinal confronting relation, each said chuck element having a flange portion acted on by a spring means for biasing said chuck body axially rearwardly with respect to said chuck actuation cylinder to said engagement position, a rear end portion for receiving an axial forward thrust to move said chuck body against said spring means to said disengagement position, and a lead engaging front portion urged by said chuck actuation cylinder in said engagement position by the spring force of said spring means to grip the writing lead;

fulcrum means positioned at confronting portions of said chuck elements at locations adjacent said flange portions for enabling relative pivotal movement of said chuck elements when in said disengagement position, said chuck elements being formed such that said rear end portions extend outwardly to form angled portions so that said angled portions function as said fulcrum means; and an annular member of a resilient material mounted about said rear end portions adjacent said fulcrum means for, when said axial forward thrust is applied to said chuck body, pivoting said chuck elements about said fulcrum means such that said rear end portions are moved radially inwardly and said lead engaging portions are moved radially outwardly to said disengagement position.

* * * * *